US006125489A

United States Patent [19]

Zeller et al.

[11] Patent Number: 6,125,489

[45] Date of Patent: Oct. 3, 2000

[54] COMBINATION FOOD AND BEVERAGE MULTITOOL

[75] Inventors: Nicole A. Zeller, Harrison; Stuart Harvey Lee, New York, both of N.Y.

[73] Assignee: Zelco Industries, Inc., Mount Vernon, N.Y.

[21] Appl. No.: 09/360,019

[22] Filed: Jul. 23, 1999

[51] Int. Cl.[7] ..... B26B 11/00

[52] U.S. Cl. ..... 7/156; 30/125; 7/106

[58] Field of Search ..... 7/106, 110, 118, 7/151, 156, 155, 158, 170; 30/125, 142; D7/643, 645

[56] References Cited

U.S. PATENT DOCUMENTS 4,918,775 4/1990 Leu ..... 7/151 X
5,513,405 5/1996 Bradbury, Jr. et al. ..... 7/158

FOREIGN PATENT DOCUMENTS 2443703 3/1976 Germany ..... 7/158

*Primary Examiner*—David A. Scherbel
*Assistant Examiner*—Anthony Ojini
*Attorney, Agent, or Firm*—Donald S. Dowden; Cooper & Dunham LLP

[57] ABSTRACT

A combination food and beverage tool includes a housing, at least one of a blade and a can opener slidably mounted within the housing and a slide mechanism for slidably moving the at least one of the blade and can opener between a first position in which the at least one of the blade and can opener is recessed within the housing and a second position in which at least a portion of the at least one of the blade and can opener is exposed outside the housing. At least one container has a first end, and a second end, and a removable lid. The first end of the container is mounted within the housing, the lid covering the second end of the container.

14 Claims, 5 Drawing Sheets

COMBINATION FOOD AND BEVERAGE MULTITOOL

BACKGROUND OF THE INVENTION

1. Field of the Invention

The present application relates to a multitool and more particularly to a combination food and beverage multitool.

2. Description of the Prior Art

Multitools provide a plurality of different tools capable of performing a plurality of functions in an efficient, compact and convenient package. A well known example of a multitool is a Swiss Army knife. The Swiss Army knife typically includes various types of knives and screwdrivers, a corkscrew, toothpick, tweezers, etc., folded into a compact unit and each of which can be unfolded or removed for use. Other types of multitools include various types of folding knife blades, screwdriver blades, pliers and/or cutters in a compact unit.

However, there is currently no multitool available that provides a combination of food and beverage tools in a compact and efficient unit for providing a food preparer, for example, with a convenient set of tools for meal preparation and cooking.

OBJECTS AND SUMMARY OF THE INVENTION

An object of the invention is to provide a combination food and beverage multitool in a compact and efficient unit.

The forgoing and other objects are attained in accordance with one aspect of the invention by providing a combination food and beverage tool including a housing, at least one of a blade and a can opener slidably mounted within the housing and a slide mechanism for slidably moving the at least one of the blade and can opener between a first position in which the at least one of blade and can opener is recessed within the housing and a second position in which at least a portion of the at least one of the blade and can opener is exposed outside the housing. At least one container has a first end, and a second end, and a removable lid. The first end of the container is mounted within the housing, the lid covering the second end of the container. The tool may include a cork screw, the cork screw being extendably recessed within the housing. The at least one container may be removably mounted within a first portion of the housing which is slidably mounted to a second portion of the housing and slidable between open and closed positions. The cork screw can be recessed within the housing when the first portion of the housing is in the closed position and can be extended from the housing when in the open position. A bottle opener can be formed integrally with the housing.

According to another aspect of the present invention, a combination food and beverage tool comprises a housing including a sliding portion slidable between open and closed positions, a knife slidably mounted within the housing and movable between a first position in which the knife is recessed within the housing and a second position in which at least a portion of the knife is exposed outside the housing and a can opener slidably mounted within the housing and movable between a first position in which the can opener is recessed within the housing and a second position in which the can opener is exposed outside the housing. A first container has a first end and a second end and a removable lid. The first end of the first container is mounted within the housing, the lid covering the second end of the first container. A second container has a first end and a second and a removable lid, the first end of the second container being mounted within the sliding portion of the housing, the lid covering the second end of the second container. A cork screw is extendable from the housing when the sliding portion of the housing is in the open position and a bottle opener is integrally formed in the housing.

According to yet another aspect of the present invention, a combination food and beverage tool comprises a housing, at least one condiment dispenser mounted within the housing and at least one tool associated with the housing, the at least one tool selected from a group consisting of a knife, a can opener, a bottle opener and a cork screw.

DESCRIPTION OF THE PREFERRED EMBODIMENT

Figure 1:
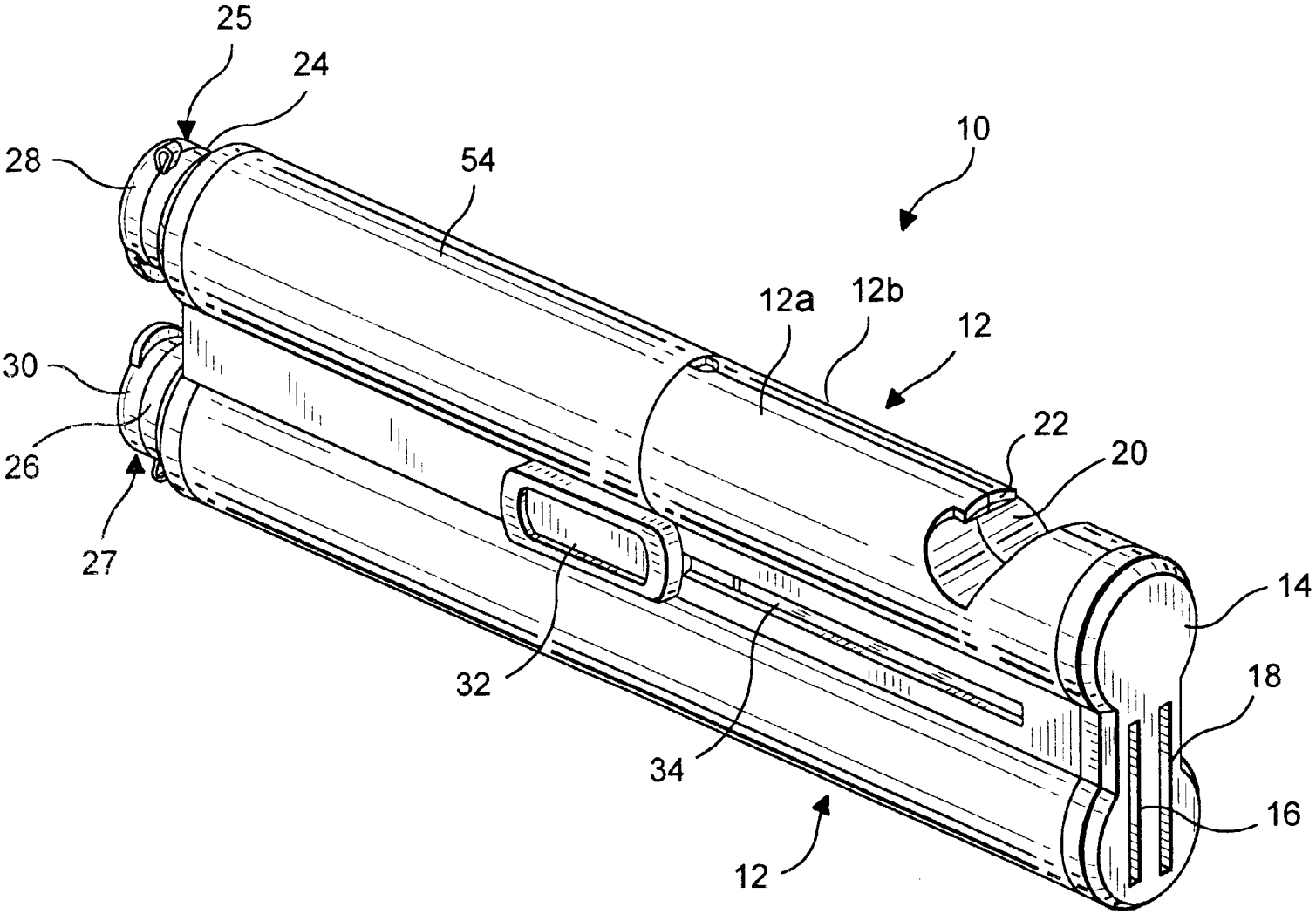
FIG. 1 is a perspective view of a combination food and beverage tool, according to an embodiment of the present invention.

FIG. 1 shows a combination food and beverage multitool 10.

Figure 2:
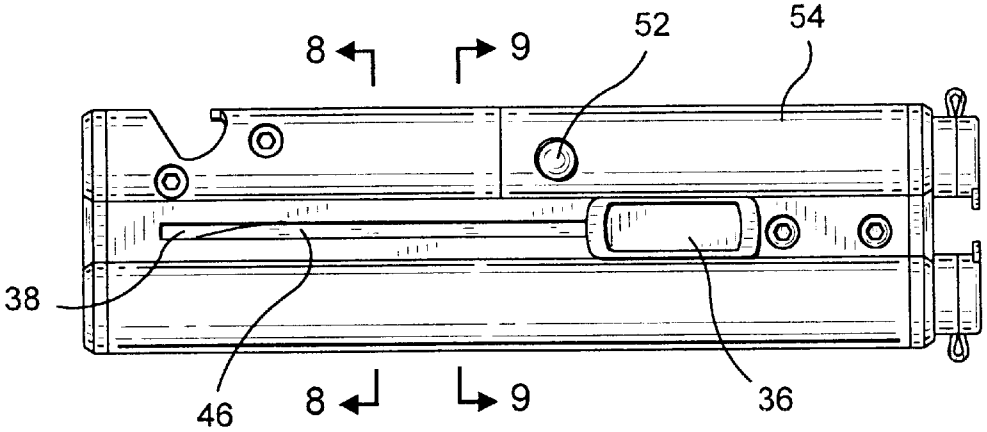
FIG. 2 is a front view of the combination food and beverage tool, according to the embodiment.

The multitool 10 comprises a main housing 12. One end of the main housing 12 is capped by an end plug 14. The end plug 14 includes a pair of longitudinal slots 16 and 18 through which a knife blade and a can opener can be extended. A recessed portion 20 and a extending lip 22 are integrally formed in the main housing 12 and together form a bottle opener. An opposite end of the main housing 12 includes a salt shaker 25 and a pepper shaker 27. Removable caps 28 and 30 cover the openings of the salt and pepper shakers 25 and 27, respectively. A slide button 32 is connected internally in the main housing 12 to a can opener (not shown). The slide button 32 slides within a track 34 formed in the main housing 12 so that the can opener can be extended through the slot 16. As FIG. 2 shows, a slide button 36 is provided on a side of the main housing 12 opposite to the side shown in FIG. 1. The slide button 36 is connected internally within the main housing 12 to a knife blade (not shown). The slide button 36 slides within a track 38 so that the knife blade can be extended through the slot 18 in the end plug 14 (see FIG. 1).

Figure 7:
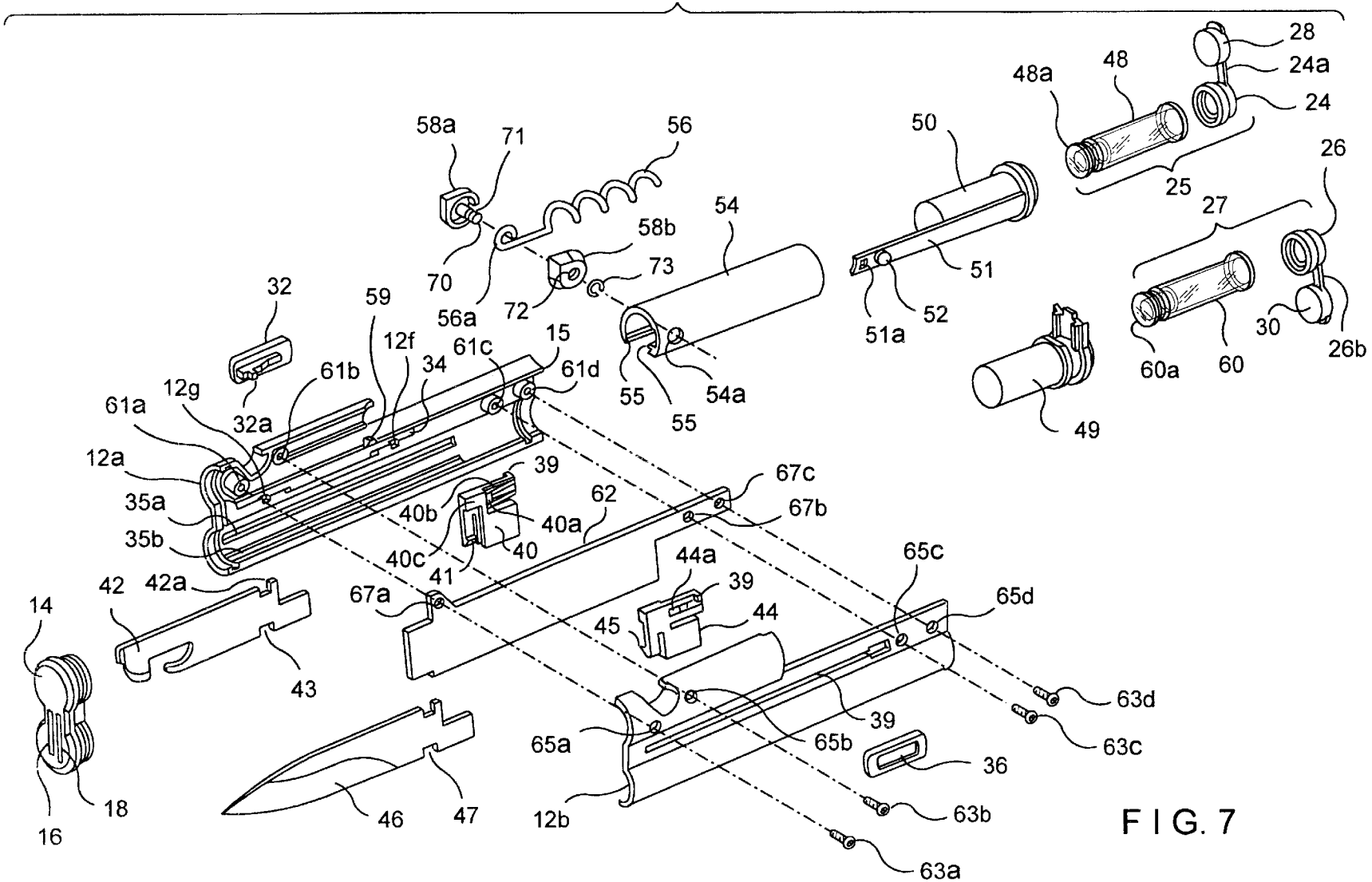
FIG. 7 is an exploded view of the combination food and beverage tool according to the embodiment of the present invention.

FIG. 7 is an exploded view of a preferred embodiment of the combination food and beverage multitool. The main housing 12 includes a first housing portion 12*a* and a second housing portion 12*b*. The first housing portion 12*a* includes threaded spacers 61*a*–61*d* integrally formed therein. The second housing portion 12*b* includes orifices 65*a*–65*d*. Screws 63*a*–63*d* extend through the orifices 65*a*–65*d*, respectively. Screws 63*a*, 63*c* and 63*d* also extend through orifices 67*a*–67*c*, respectively, in a chamber divider 62. The screws 63*a*–63*d* screw into the threaded spacers 61*a*–61*d*, respectively, for maintaining the first and second housing portions 12*a*, 12*b* together as a unit.

A can opener 42 is mounted in a can opener retainer 40. The can opener 42 slides into the can opener retainer 40 until a tab 42*a* enters a slot (not shown) in a section 40*c* of the retainer 40 and a locking member 41 engages a notch 43, thereby locking the retainer 40 onto the can opener 42. The can opener retainer 40 is slidably mounted between the chamber divider 62 and slide portions 35*a* and 35*b* which are integrally formed in the first housing portion 12*a*. The slide button 32 includes a pin 32*a* which extends through the track 34 in the first housing portion 12*a* and into a notch 40*a* in the can opener retainer 40. The can opener retainer 40 includes a lock 39 that engages locking notches 12*f* and 12*g* for locking the can opener 42 in the closed and open positions, respectively. The lock 39 extends from the end of a flexible arm 40*b* and can be released from the notches 12*f* and 12*g* by pushing in the slide button 32 enabling the slide button 32 to slide freely so that the can opener 42 can be extended and retracted as desired.

Figure 8:
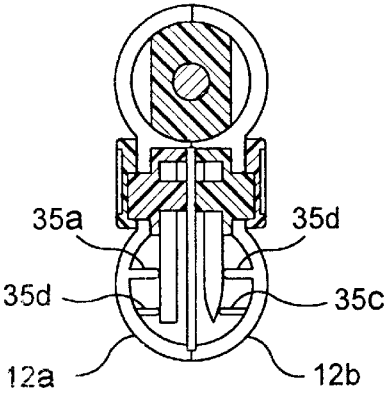
FIG. 8 is a cross-sectional view the combination food and beverage tool as shown in FIG. 2, taken along the lines 8—8.

In a similar manner, a knife blade 46 is mounted in a knife blade retainer 44. The knife blade 46 slides into the knife blade retainer 44 until a locking member 45 engages a notch 47, thereby locking the retainer 44 onto the knife blade 46. The slide button 36 also includes a pin (not shown) that extends through the track 38 in the second housing portion 12*b* and into a notch 44*a* in the knife blade retainer 44. The knife blade retainer 44 is slidably mounted between the chamber divider 62 and slide portions (see FIG. 8, the slide portions 35*c*, 35*d*) on the second housing portion 12*b*.

The retainer 44 also includes a lock 39 and the second housing portion 12*b* includes notches (not shown) so that the knife blade 46 can be locked in the extended and retracted positions. The end plug 14 fits into a first end of the main housing 12 and includes longitudinal slots 16 and 18 through which the can opener 42 and the knife blade 46, respectively, can be extended. A cork screw consists of a cork screw unit 56 and a swivel stop 58 formed of swivel stop halves 58*a* and 58*b*. A pin 70 extends from the swivel stop half 58*a*, through a closed bend 56*a* in the cork screw unit 56 and through an orifice 72 in the swivel stop half 58*b*. A retaining clip 73 clips over a groove 71 formed in the pin 70 for holding the swivel stop halves 58*a* and 58*b* together.

Figure 9:
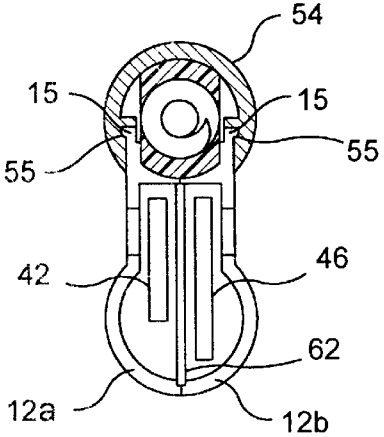
FIG. 9 is a cross-sectional view of the combination food and beverage tool as shown in FIG. 2, taken along the lines 9—9.

The multitool 10 also includes a slide housing portion 54 including grooves 55. As shown in cross section in FIG. 9, the grooves 55 slide on tracks 15 provided on the first housing portion 12*a*, allowing the slide housing portion 54 to be moved between open and closed positions. A container holder 50 fits within the slide housing portion 54 and is glued or otherwise mounted therein. An arm 51 extends from the holder 50. The arm 51 includes a release button 52 and a clasp 51*a*. The release button 52 extends through a hole 54*a* in the slide housing portion 54. When the slide housing portion 54 is in the closed position as shown in FIG. 1, the clasp 51*a* engages a corresponding notch (not shown) in the second housing portion 12*b*, locking the slide housing portion 54 in the closed position. When the release button 52 is pushed in, the clasp 51*a* is released and the slide housing portion 54 can be slid to the open position shown in FIG. 10.

Referring again to FIG. 7, a salt container 48 has a threaded base portion 48*a* and an inside bottom of the container holder 50 has threads (not shown) corresponding thereto. The salt container 48 can thus be screwed into the container holder 50 and retained therein. A salt cap 24 clips onto the end of the salt container 48 and includes the removable cap 28 which is attached thereto by a tab 24*b*. A container holder 49 is provided in a lower portion of the main housing 12 and is glued or otherwise mounted therein. A pepper container 60 has a threaded base portion 60*a* and an inside bottom of the container holder 49 also has threads (not shown) corresponding thereto. The pepper container 60 can thus be screwed into the container holder 49 and retained therein. A pepper cap 26 is clipped onto an end of the pepper container 60 and includes a removable cap 30 attached thereto by a tab 26*b*, for covering the pepper container 60.

Figure 3:
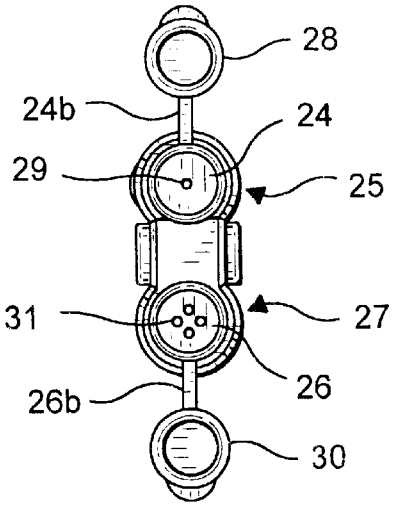
FIG. 3 is an end view of the combination food and beverage tool according to the embodiment of the present invention.
Figure 4:
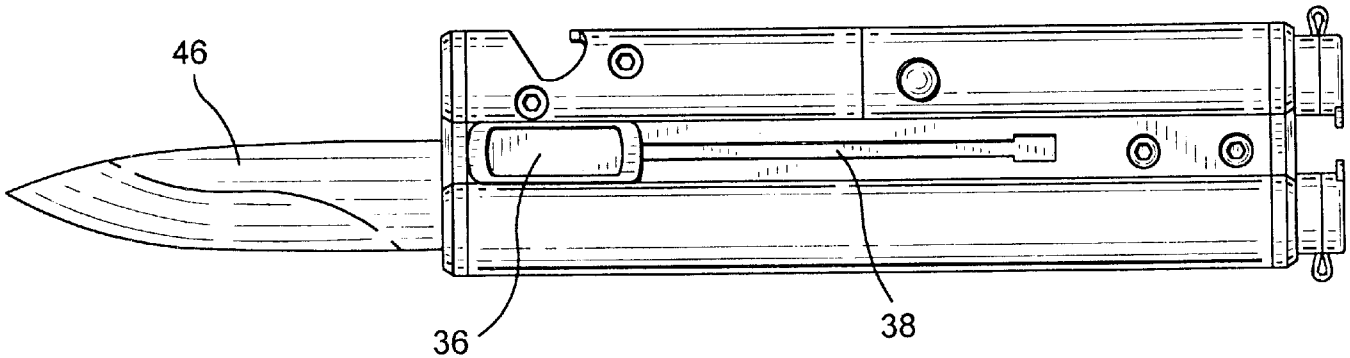
FIG. 4 is a front view of the combination food and beverage tool, according to the embodiment, with the knife blade extended.
Figure 5:
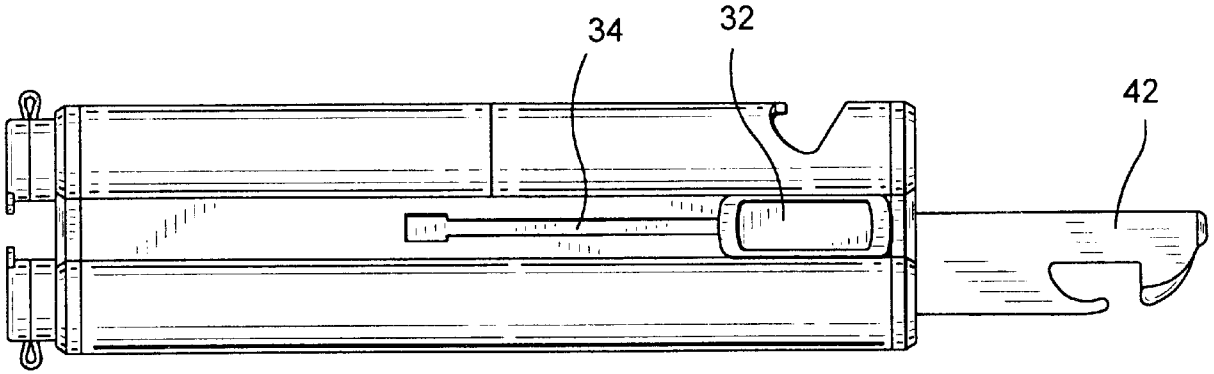
FIG. 5 is a front view of the combination food and beverage tool with the can opener ready for use.
Figure 6:
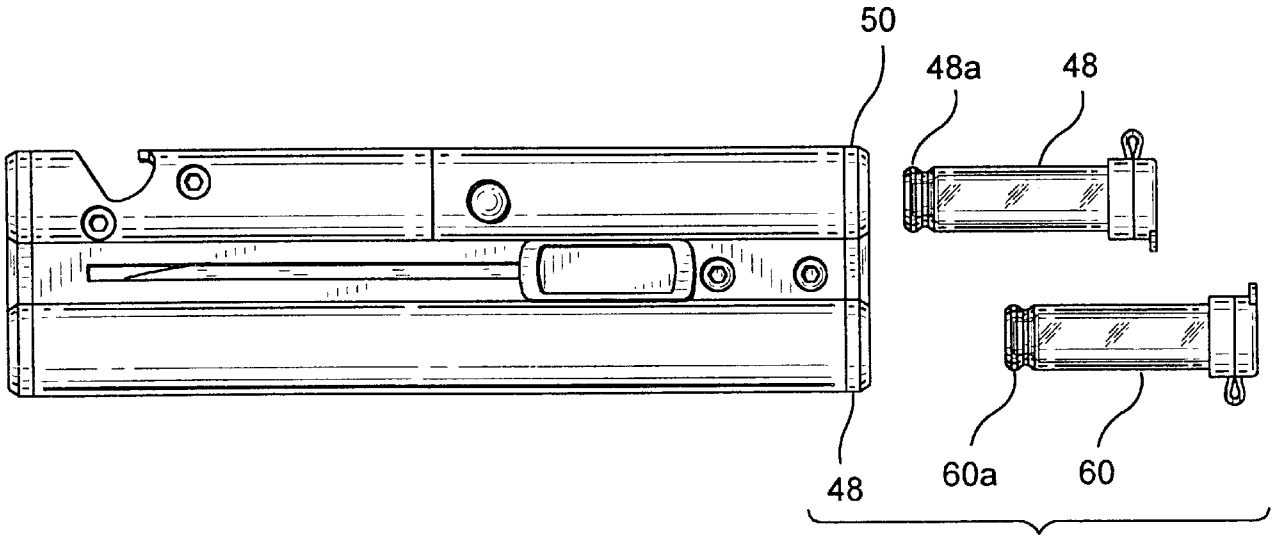
FIG. 6 is front view with the salt and pepper holders withdrawn from corresponding positions in the main housing.

FIG. 4 shows the slide button 36 extended to its full forward position within the track 38 so that the knife blade 46 extends from the multitool 10. FIG. 5 shows the slide button 32 extended to its full forward position within the track 34 so that the can opener 42 extends from the multitool 10. As shown in FIG. 6, the salt container 48 and the pepper container 60 can easily be unscrewed and removed from the main housing 12 allowing them to be readily cleaned and refilled as necessary. As shown in FIG. 3 the salt cap 24 includes a single hole or orifice 29 allowing salt to be dispensed from the salt shaker 25. The pepper cap 26 includes a plurality of orifices 31 allowing pepper to be dispensed from the pepper shaker 27.

Figure 10:
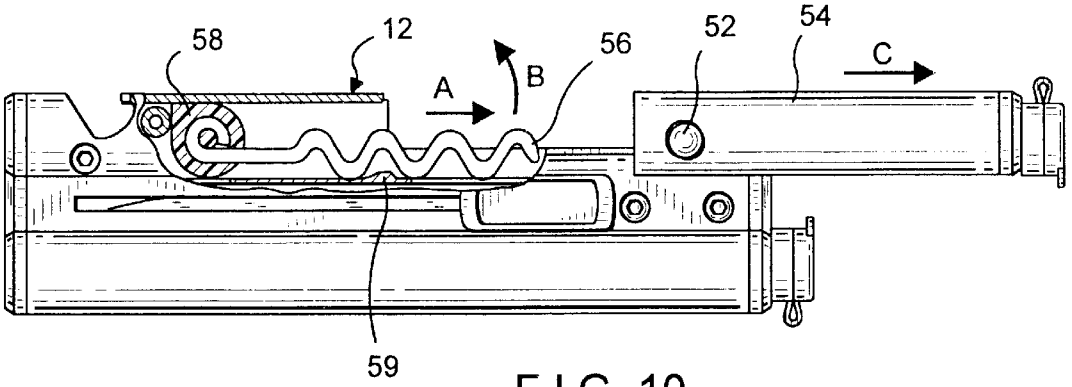
FIG. 10 is a front view of the combination food and beverage tool with a cover member partially slid open to access a corkscrew.
Figure 11:
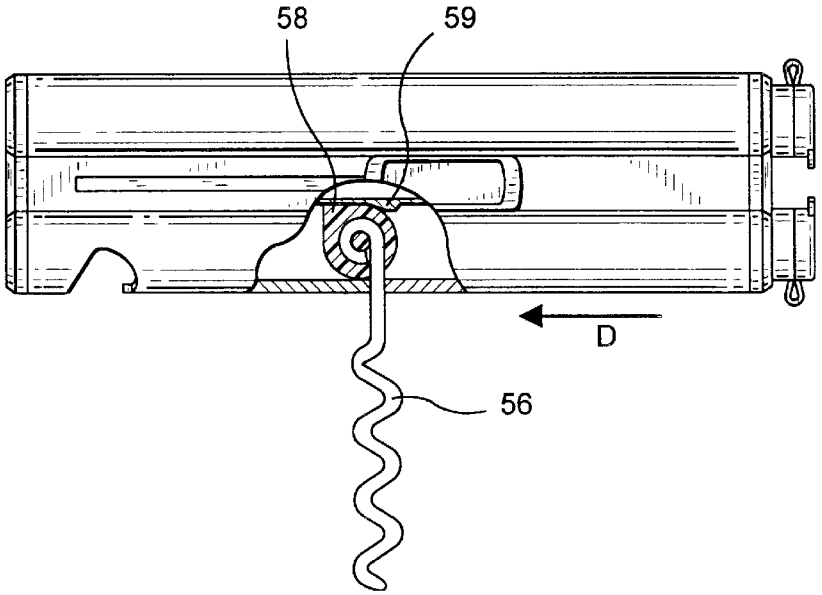
FIG. 11 is a rear view of the combination food and beverage tool with the corkscrew ready for use.

FIGS. 10 and 11 show the operation of extending the cork screw 56 from the main housing 12 for use. As shown in FIG. 10, after pressing the release button 52 which releases the clasp 51*a* (see FIG. 7), the slide housing portion 54 can be slid in the direction of arrow C. The swivel stop 58 is slidable within the main housing 12 so that the cork screw 56 can be moved in the direction of arrow A. The cork screw 56 is slid in the direction of arrow A until the swivel stop 58 contacts a stop 59 provided on the main housing 12. At this position, the cork screw 56 can be swiveled upwards in the direction of arrow B. The swivel stop 58 is oblong shaped to prevent the corkscrew 56 from over extending when being rotated in direction of arrow B, as seen in FIG. 11. The slide housing portion 54 can then be slid back into position by sliding it in the direction of arrow D. The cork screw 56 is then ready to be used.

In describing preferred embodiments of the present invention illustrated in the drawings, specific terminology is employed for clarity. However, the present invention is not limited by that terminology; each specified element includes all of its equivalents.

What is claimed is:

1. A combination food and beverage tool comprising:

a housing;

at least one of a blade and a can opener slidably mounted within the housing;

a slide mechanism for slidably moving the at least one of the blade and can opener between a first position in which the at least one of the blade and can opener is recessed within the housing and a second position in which at least a portion of the at least one of the blade and can opener is exposed outside the housing; and at least one container having a first end, and a second end, and a removable lid, the first end of the container being mounted within the housing, the lid covering the second end of the container.

2. A combination food and beverage tool as recited in claim 1, further comprising a cork screw, the cork screw being extendably recessed within the housing.

3. A combination food and beverage tool as recited in claim 2, wherein said at least one container is removably mounted within a first portion of the housing which is slidably mounted to a second portion of the housing, the first portion of the housing being slidable between open and closed positions and wherein the cork screw is recessed within the housing when the first portion of the housing is in the closed position and can be extended from the housing when the first portion of the housing is in the open position.

4. A combination food and beverage tool as recited in claim 1, further comprising a bottle opener, the bottle opener being formed integrally with the housing.

5. A combination food and beverage tool as recited in claim 1, wherein the at least one container is removably mounted in the housing.

6. A combination food and beverage tool comprising:

a housing including a sliding portion slidable between open and closed positions;

a knife slidably mounted within the housing and movable between a first position in which the knife is recessed within the housing and a second position in which at least a portion of the knife is exposed outside the housing;

a can opener slidably mounted within the housing and movable between a first position in which the can opener is recessed within the housing and a second position in which the can opener is exposed outside the housing;

a first container having a first end and a second end and a removable lid, the first end of the first container being mounted within the housing, the lid covering the second end of the first container;

a second container having a first end and a second and a removable lid, the first end of the second container being mounted within the sliding portion of the housing, the lid covering the second end of the second container;

a cork screw extendable from the housing when the sliding portion of the housing is in the open position; and a bottle opener integrally formed in the housing.

7. A combination food and beverage tool comprising:

a housing;

at least one condiment dispenser mounted within the housing; and at least one tool associated with the housing, the at least one tool selected from a group consisting of a knife, a can opener, a bottle opener and a cork screw.

8. A combination food and beverage tool as recited in claim 7, wherein the at least one condiment dispenser comprises a pepper shaker.

9. A combination food and beverage tool as recited in claim 7, wherein the at least one condiment dispenser comprises a salt shaker.

10. A combination food and beverage tool as recited in claim 7, wherein the at least one condiment dispenser comprises a salt and a pepper shaker.

11. A combination food and beverage tool as recited in claim 7, wherein the at least one condiment dispenser has a first end and a second end and a removable lid, the first end of the dispenser being mounted within the housing, the lid covering the second end of the dispenser.

12. A combination food and beverage tool as recited in claim 11, wherein the first end of the dispenser is removably mounted within the housing.

13. A combination food and beverage tool as recited in claim 7, further comprising a slide housing portion slidable between open and closed positions.

14. A combination food and beverage tool as recited in claim 7, wherein the knife and can opener are slidably mounted within the housing and movable between first and second positions.

* * * * *